US010138713B2

(12) United States Patent
Tolman et al.

(10) Patent No.: US 10,138,713 B2
(45) Date of Patent: Nov. 27, 2018

(54) AUTONOMOUS WELLBORE DEVICES WITH ORIENTATION-REGULATING STRUCTURES AND SYSTEMS AND METHODS INCLUDING THE SAME

(71) Applicants: Randy C. Tolman, Spring, TX (US); Timothy I. Morrow, Humble, TX (US)

(72) Inventors: Randy C. Tolman, Spring, TX (US); Timothy I. Morrow, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 707 days.

(21) Appl. No.: 14/816,388

(22) Filed: Aug. 3, 2015

(65) Prior Publication Data

US 2016/0069163 A1 Mar. 10, 2016

Related U.S. Application Data

(60) Provisional application No. 62/047,461, filed on Sep. 8, 2014.

(51) Int. Cl.
*E21B 41/00* (2006.01)
*E21B 43/119* (2006.01)
(Continued)

(52) U.S. Cl.
CPC ..... *E21B 41/00* (2013.01); *E21B 7/06* (2013.01); *E21B 23/10* (2013.01); *E21B 43/119* (2013.01)

(58) Field of Classification Search
CPC ..... E21B 23/10; E21B 43/119; E21B 41/00; E21B 7/06
See application file for complete search history.

(56) References Cited

U.S. PATENT DOCUMENTS 3,964,553 A * 6/1976 Basham ..... E21B 43/119 166/55.1
4,109,717 A * 8/1978 Cooke, Jr. ..... E21B 47/02 166/250.1

(Continued)

FOREIGN PATENT DOCUMENTS

WO WO 2014/093649 A1 6/2014
WO WO 2015/099885 A1 7/2015

*Primary Examiner* — Yong-Suk Ro
(74) *Attorney, Agent, or Firm* — ExxonMobil Upstream Research Company—Law Department

(57) ABSTRACT

Autonomous wellbore devices with orientation-regulating structures are disclosed, including systems and methods using the same. The autonomous wellbore devices include a wellbore tool, a control structure, and an orientation-regulating structure. The wellbore tool is configured to autonomously perform a downhole operation within a wellbore conduit that extends within a subterranean formation. The control structure is programmed to determine that an actuation criterion has been satisfied and to provide an actuation signal to the wellbore tool. The orientation-regulating structure is configured to regulate a cross-sectional orientation of the wellbore tool while the autonomous wellbore device is being conveyed autonomously within the wellbore conduit. The methods include performing the downhole operation with the autonomous wellbore device, including locating the device within the wellbore conduit, autonomously conveying the device within the wellbore conduit, autonomously regulating the cross-sectional orientation of the wellbore tool, and autonomously actuating the wellbore tool.

27 Claims, 7 Drawing Sheets

(51) Int. Cl.
*E21B 7/06* (2006.01)
*E21B 23/10* (2006.01)

(56) References Cited

U.S. PATENT DOCUMENTS

| | | | | |
|---|---|---|---|---|
| 4,410,051 | A | 10/1983 | Daniel et al. | |
| 5,010,964 | A * | 4/1991 | Cornette | E21B 43/119 166/297 |
| 5,259,466 | A * | 11/1993 | Venditto | E21B 43/119 166/297 |
| 6,032,739 | A * | 3/2000 | Newman | E21B 29/02 166/255.2 |
| 6,173,773 | B1 * | 1/2001 | Almaguer | E21B 43/119 166/241.1 |
| 6,843,318 | B2 | 1/2005 | Yarbro | |
| 8,066,083 | B2 | 11/2011 | Hales et al. | |
| 8,127,848 | B2 | 3/2012 | Myers, Jr. et al. | |
| 8,201,625 | B2 * | 6/2012 | Almaguer | E21B 7/061 166/250.08 |
| 8,365,814 | B2 | 2/2013 | Hill et al. | |
| 2002/0189802 | A1 * | 12/2002 | Tolman | E21B 17/10 166/55 |
| 2003/0188867 | A1 * | 10/2003 | Parrott | E21B 17/05 166/297 |
| 2005/0241824 | A1 * | 11/2005 | Burris, II et al. | E21B 23/00 166/255.1 |
| 2011/0024117 | A1 | 2/2011 | Lopez De Cardenas et al. | |
| 2011/0132607 | A1 | 6/2011 | Lahitette et al. | |
| 2013/0062055 | A1 * | 3/2013 | Tolman | E21B 23/00 166/250.01 |

* cited by examiner

AUTONOMOUS WELLBORE DEVICES WITH ORIENTATION-REGULATING STRUCTURES AND SYSTEMS AND METHODS INCLUDING THE SAME

CROSS-REFERENCE TO RELATED APPLICATION

This application claims the benefit of U.S. Provisional Patent Application 62/047,461, filed Sep. 8, 2014, entitled "Autonomous Wellbore Devices With Orientation-Regulating Structures and Systems and Methods Including The Same," the entirety of which is incorporated by reference herein.

FIELD OF THE DISCLOSURE

The present disclosure is directed generally to autonomous wellbore devices and more particularly to autonomous wellbore devices that include an orientation-regulating structure that is configured to regulate an orientation of the autonomous wellbore devices within a wellbore conduit and/or to systems and methods that include the autonomous wellbore devices.

BACKGROUND OF THE DISCLOSURE

Autonomous wellbore devices may be utilized to perform one or more operations within a wellbore conduit that extends within a subterranean formation. As an example, an autonomous wellbore device, in the form of an autonomous perforation gun, may be utilized to create one or more perforations within a wellbore tubular that defines the wellbore conduit. Generally, autonomous wellbore devices are pre-programmed prior to being released within the wellbore conduit and then are carried, or flowed, in a downhole direction within the wellbore conduit by a fluid stream and/or gravity. Within the wellbore conduit, downhole from a surface region, the autonomous wellbore devices then self-actuate responsive to a triggering event. As examples, the autonomous wellbore device may self-actuate responsive to being flowed through a target length of the casing conduit and/or responsive to reaching a target depth within the subterranean formation.

Autonomous wellbore devices generally are not capable of regulating and/or controlling a rotational orientation and/or a cross-sectional location thereof within the casing conduit. This fact may produce undesired, or unintended, consequences when an autonomous wellbore device actuates. As an example, and when the autonomous wellbore device is the autonomous perforation gun, the lack of control of the rotational orientation of the autonomous perforation gun may preclude the use of the autonomous perforation gun in wellbores that include structures that might be damaged by perforation thereof. Such structures may include cables, other wellbore devices, sensors, and/or other wellbore tubulars that may be present within the wellbore.

As another example, the lack of control of the rotational orientation of the autonomous perforation gun may preclude the ability to predetermine and/or specify an orientation of perforations that may be created in the wellbore tubular by the autonomous perforation gun. As yet another example, the lack of cross-sectional location control may cause the autonomous perforation gun to produce perforations of varying and/or irregular size, angle, and/or geometry. This may complicate stimulation and/or diversion operations that may utilize the perforations and/or subsequently need to seal the perforations. Thus, there exists a need for autonomous wellbore devices with orientation-regulating structures, as well as for systems and methods that may include and/or utilize the autonomous wellbore devices.

SUMMARY OF THE DISCLOSURE

Autonomous wellbore devices with orientation-regulating structures and systems and methods including the same are disclosed herein. The autonomous wellbore device includes a wellbore tool that is configured to autonomously perform a downhole operation responsive to receipt of an actuation signal. The wellbore tool is configured to be located within a wellbore conduit that is defined by a wellbore tubular that extends within a subterranean formation, and the wellbore tool is configured to perform the downhole operation within the wellbore conduit.

The autonomous wellbore device also includes a control structure. The control structure is configured to be conveyed autonomously within the wellbore conduit with the wellbore tool. In addition, the control structure is programmed to determine that an actuation criterion has been satisfied and to provide the actuation signal to the wellbore tool responsive to satisfaction of the actuation criterion.

The autonomous wellbore device further includes an orientation-regulating structure. The orientation-regulating structure is configured to be conveyed autonomously within the wellbore conduit with the wellbore tool. The orientation-regulating structure also is configured to regulate a cross-sectional orientation of the wellbore tool within the wellbore conduit while the autonomous wellbore device is being conveyed autonomously within the wellbore conduit.

In some embodiments, the orientation-regulating structure is a passive orientation-regulating structure that is configured to passively regulate the cross-sectional orientation of the wellbore tool. In some embodiments, the orientation-regulating structure is an active orientation-regulating structure that is configured to actively regulate the cross-sectional orientation of the wellbore tool.

In some embodiments, the orientation-regulating structure includes a cross-sectional location-regulating structure configured to regulate a cross-sectional location of the wellbore tool within the wellbore conduit. In some embodiments, the orientation-regulating structure includes an angular orientation-regulating structure configured to regulate an angular orientation of the wellbore tool within the wellbore conduit.

In some embodiments, the wellbore tool includes a perforation device and the downhole operation includes forming at least one perforation within the wellbore tubular. In some embodiments, the orientation-regulating structure is configured to center the perforation device within the wellbore conduit, to rotate the perforation device such that the perforation is formed at a desired angular orientation within the wellbore tubular, and/or to rotate the perforation device to avoid perforation of a wellbore structure that may extend within and/or proximate the wellbore conduit.

The methods include methods of performing the downhole operation with the autonomous wellbore device. The methods include locating the autonomous wellbore device within the wellbore conduit. The methods also include autonomously conveying the autonomous wellbore device in a downhole direction within the wellbore conduit. This may include autonomously conveying the autonomous wellbore device to a downhole portion of the wellbore conduit. The methods further include autonomously regulating the cross-sectional orientation of the wellbore tool within the wellbore conduit while the autonomous wellbore device is within the downhole portion of the wellbore conduit. The methods also include autonomously actuating the wellbore tool such that the wellbore tool performs the downhole operation while the autonomous wellbore device is located within the downhole portion of the wellbore conduit.

In some embodiments, the autonomously regulating includes regulating the cross-sectional location of the wellbore tool within the wellbore conduit. In some embodiments, the autonomously regulating includes regulating the angular orientation of the wellbore tool within the wellbore conduit. In some embodiments, the downhole operation includes perforation of the wellbore tubular and the autonomously actuating includes perforating the wellbore tubular.

DETAILED DESCRIPTION AND BEST MODE OF THE DISCLOSURE

Figure 1:
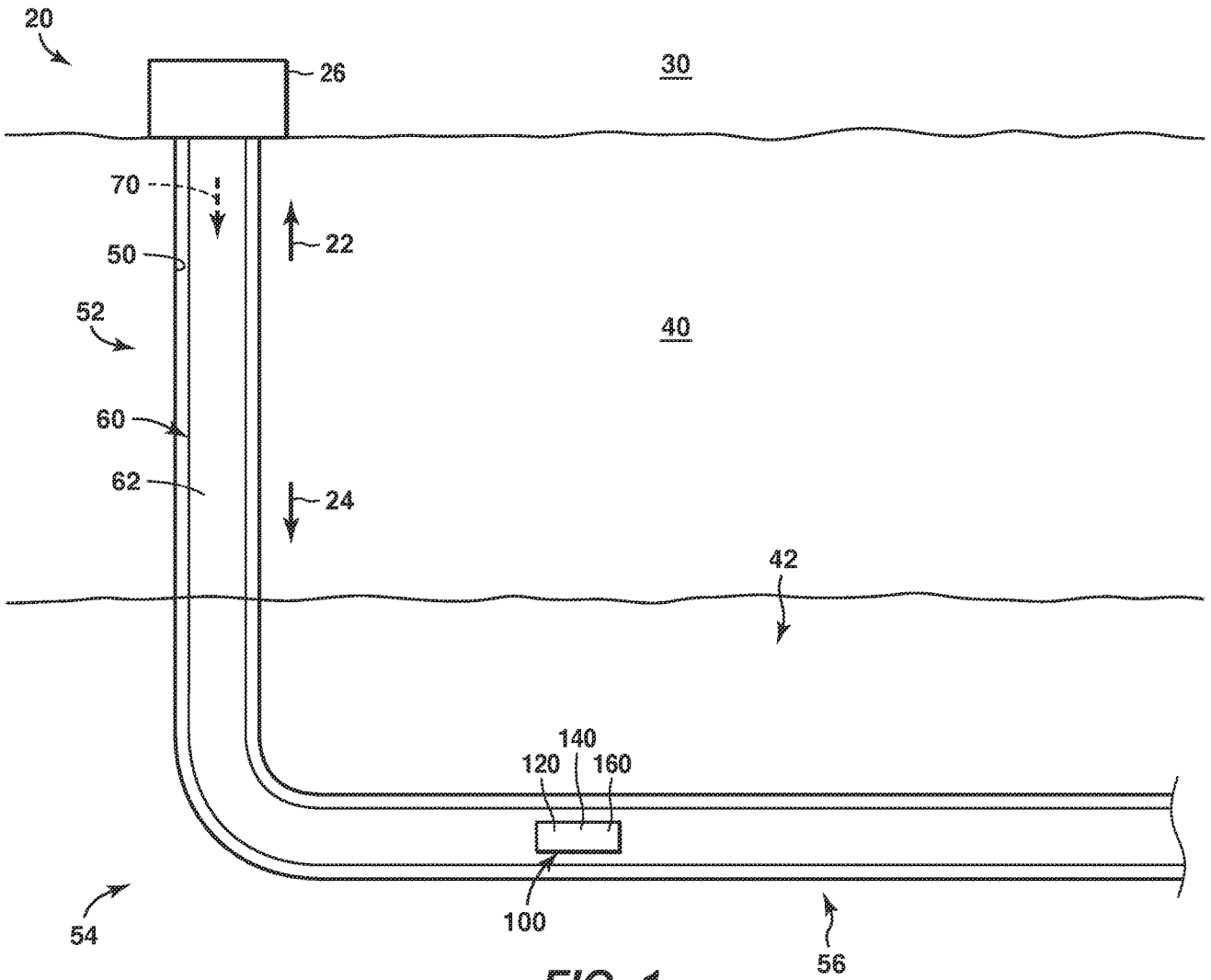
FIG. 1 is a schematic view of a hydrocarbon well that may include, utilize, and/or contain an autonomous wellbore device according to the present disclosure.

FIGS. 1-15 provide examples of autonomous wellbore devices 100 according to the present disclosure, of hydrocarbon wells 20 and/or wellbore conduits 62 that include, contain, and/or utilize autonomous wellbore devices 100, and/or of methods 400, according to the present disclosure, of performing a downhole operation with autonomous wellbore devices 100. Elements that serve a similar, or at least substantially similar, purpose are labeled with like numbers in each of FIGS. 1-15, and these elements may not be discussed in detail herein with reference to each of FIGS. 1-15. Similarly, all elements may not be labeled in each of FIGS. 1-15, but reference numerals associated therewith may be utilized herein for consistency. Elements, components, and/or features that are discussed herein with reference to one or more of FIGS. 1-15 may be included in and/or utilized with any of FIGS. 1-15 without departing from the scope of the present disclosure.

In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

FIG. 1 is a schematic view of a hydrocarbon well 20 that may include, utilize, and/or contain an autonomous wellbore device 100 according to the present disclosure. As illustrated in FIG. 1, hydrocarbon well 20 may include a wellbore 50. Wellbore 50 may extend within a subterranean formation 42, which may be present within a subsurface region 40, and/or may extend between a surface region 30 and the subterranean formation. A wellbore tubular 60 may extend within wellbore 50 and may define a wellbore conduit 62. Wellbore 50 may include a vertical portion 52, a deviated portion 54, and/or a horizontal portion 56, and autonomous wellbore device 100 may be located, utilized, and/or operated within the vertical portion, within the deviated portion, and/or within the horizontal portion.

During operation of hydrocarbon well 20, autonomous wellbore device 100, which also may be referred to herein as device 100 and/or autonomous device 100, may be located within wellbore conduit 62. Subsequently, device 100 may be conveyed autonomously within wellbore conduit 62. This may include being conveyed autonomously in an uphole direction 22 and/or in a downhole direction 24. For example, device 100 may be conveyed autonomously in downhole direction 24 such that device 100 is located within a subterranean portion of wellbore conduit 62 (i.e., a portion of wellbore conduit 62 that extends within subsurface region 40 and/or within subterranean formation 42). As another example, device 100 may be conveyed autonomously in downhole direction 24 such that device 100 is located downhole from a surface structure 26 that may be associated with and/or may form a portion of hydrocarbon well 20.

Figure 2:
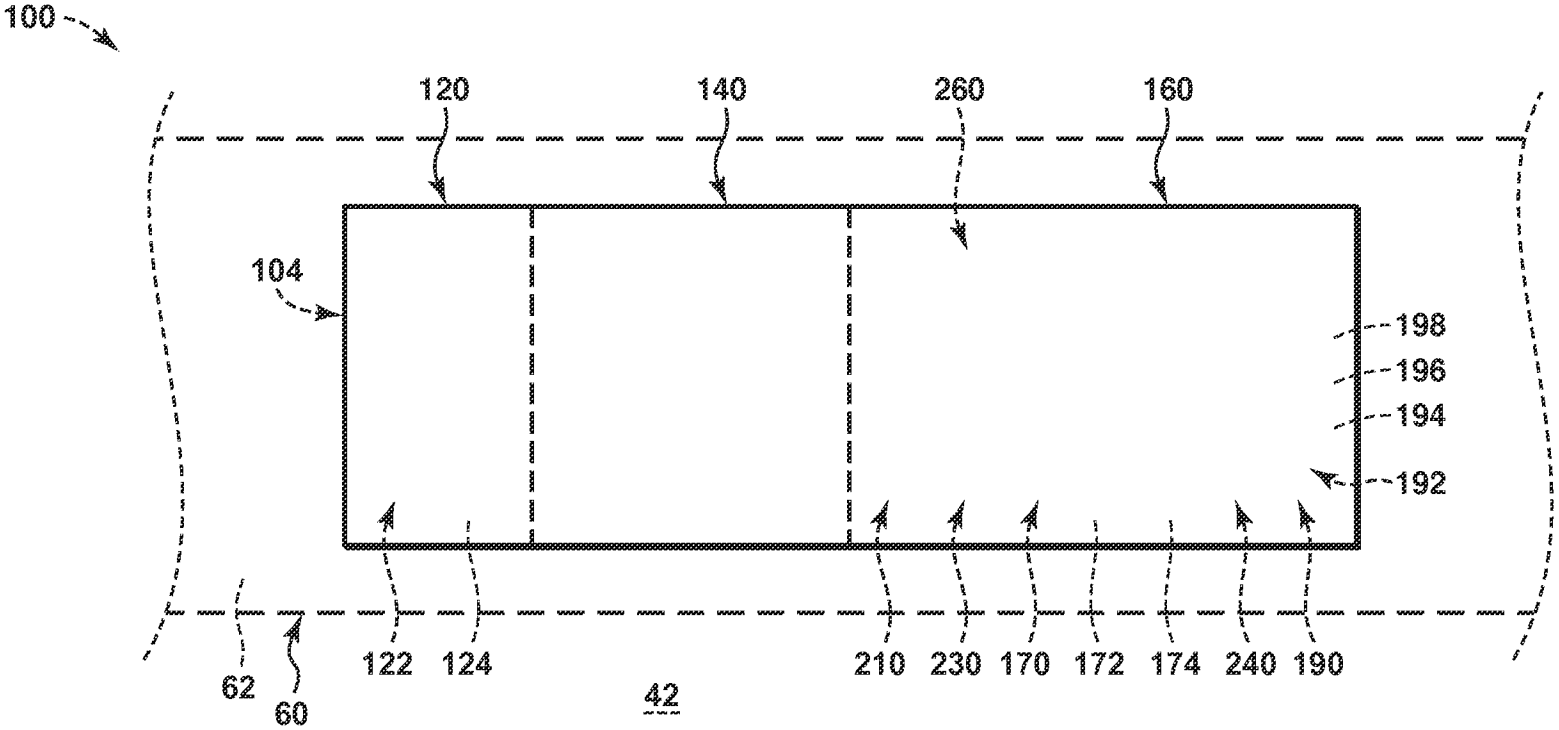
FIG. 2 is a schematic side view of an autonomous wellbore device according to the present disclosure.

As indicated schematically in FIGS. 1 and 2, autonomous wellbore device 100 may include a wellbore tool 120, a control structure 140, and/or an orientation-regulating structure 160. Wellbore tool 120 also may be referred to herein as a tool 120 and may be adapted and/or configured to perform a downhole operation within wellbore conduit 62 autonomously. Control structure 140 may be programmed to control the operation of at least a portion of device 100. Orientation-regulating structure 160 also may be referred to herein as a rotation structure 160 and may be adapted, configured, and/or programmed to control a cross-sectional location of device 100 while device 100 is being conveyed autonomously within the wellbore conduit. Examples of device 100, of wellbore tools 120, of control structure 140, and/or of orientation-regulating structures 160 are discussed in more detail herein with reference to FIGS. 2-14. Any of the components and/or features of device 100 of FIGS. 2-14 may be included in and/or utilized with device 100 of FIG. 1 without departing from the scope of the present disclosure.

As used herein, the phrase, "autonomous wellbore device" may refer to any suitable discrete and/or independent downhole device that may be designed, adapted, sized, and/or configured to be deployed within wellbore conduit 62 without a physical attachment, or tether, that extends between the autonomous wellbore device and surface region 30. As an example, autonomous wellbore devices 100 according to the present disclosure may be unattached to, may not be attached to, and/or may never be attached to surface structure 26, at least while the autonomous wellbore devices are located within wellbore conduit 62, are being conveyed within wellbore conduit 62, and/or are located within the subterranean portion of wellbore conduit 62. In addition, autonomous wellbore devices 100 according to the present disclosure also may be configured for independent and/or autonomous operation within wellbore conduit 62. As such, the autonomous wellbore devices may be configured to direct the wellbore tool to perform the downhole operation without, or independent from, communication with surface region 30.

As discussed, autonomous wellbore device 100 may be conveyed within wellbore conduit 62. This may include device 100 being conveyed in uphole direction 22 and/or in downhole direction 24, and the conveyance may be accomplished in any suitable manner. As an example, device 100 may be conveyed during motion and/or translation of device 100 within wellbore conduit 62. As a more specific example, a fluid stream 70 may be provided to wellbore conduit 62, and device 100 may be swept, flowed, and/or conveyed in, or within, fluid stream 70 along the wellbore conduit. As another more specific example, device 100 may be conveyed within wellbore conduit 62 under the influence of gravity. As yet another more specific example, device 100 may be conveyed within wellbore conduit 62 by a tractor that itself is not connected to the surface region by a wireline, tubular, or other tether-like device that may be used to stop movement of the tractor in a downhole direction and draw the tractor back toward the surface region.

Orientation-regulating structure 160 may be adapted, configured, designed, and/or constructed to regulate a cross-sectional orientation of device 100 and/or of wellbore tool 120 thereof while device 100 is located and/or being conveyed within wellbore conduit 62. This may include regulation of a cross-sectional location of device 100 (and/or wellbore tool 120 thereof) and/or regulation of an angular orientation of device 100 (and/or wellbore tool 120) and is discussed in more detail herein.

FIG. 2 is a schematic side view of an autonomous wellbore device 100 according to the present disclosure. Device 100 includes a wellbore tool 120, a control structure 140, and an orientation-regulating structure 160. In devices 100 according to the present disclosure, tool 120, control structure 140, and orientation-regulating structure 160 are operatively attached to one another and are sized to be located, deployed, and/or conveyed within a wellbore conduit 62 as a single unit. Thus, device 100 may be a unitary structure that may include tool 120, control structure 140, and orientation-regulating structure 160. Additionally or alternatively, device 100 may include a housing 104 that includes and/or contains at least a portion, or even all, of tool 120, control structure 140, and orientation-regulating structure 160. As discussed, wellbore conduit 62 may be defined by a wellbore tubular 60 that may extend within a subterranean formation 42.

Orientation-regulating structure 160 may be operatively affixed to tool 120 and/or to control structure 140. In addition, orientation-regulating structure 160 may be configured to be conveyed autonomously within wellbore conduit 62 with tool 120 and/or with control structure 140. Furthermore, orientation-regulating structure 160 may be adapted, configured, designed, and/or constructed to control and/or regulate a cross-sectional orientation of device 100 and/or of tool 120 thereof while device 100 is located and/or being conveyed autonomously within the wellbore conduit.

Figure 4:
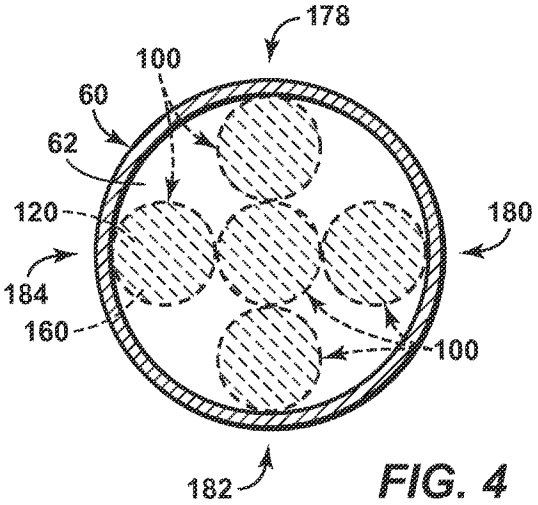
FIG. 4 is a schematic end view showing a plurality of positions of an autonomous wellbore device according to the present disclosure, located within a wellbore conduit.
Figure 3:
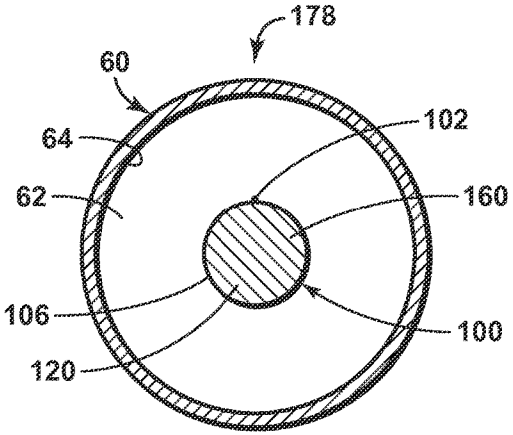
FIG. 3 is a schematic end view of an autonomous wellbore device according to the present disclosure, located within a wellbore conduit.

As used herein, the phrase, "cross-sectional orientation" may refer to a "cross-sectional location" of device 100 within wellbore conduit 62 and/or to an "angular orientation" of device 100 within wellbore conduit 62. As used herein, the phrase, "cross-sectional location" may refer to a spatial location and/or position of device 100 within a cross-section of wellbore conduit 62, and orientation-regulating structure 160 may be adapted, configured, designed, and/or constructed to control and/or regulate the cross-sectional location of device 100. This may include maintaining device 100 and/or tool 120 thereof within a target portion of a transverse cross-section of wellbore conduit 62, such as illustrated in FIGS. 3-4. In FIG. 3, orientation-regulating structure 160 of device 100 is maintaining device 100 (at least substantially) centered within wellbore conduit 62. FIG. 4 illustrates device 100 in dashed lines to indicate a variety of different (optional) cross-sectional locations for device 100 within wellbore conduit 62. Device 100 may be maintained in and/or urged to and/or toward a selected one of these different cross-sectional locations by orientation-regulating structure 160.

Orientation-regulating structure 160 may control and/or regulate the cross-sectional location of device 100 in any suitable manner. As an example, orientation-regulating structure 160 may control and/or regulate an average distance between an outer surface 106 of device 100 and an inner surface 64 of a wellbore tubular 60 that defines wellbore conduit 62 (as illustrated in FIG. 3). As another example, orientation-regulating structure 160 may control and/or regulate a minimum distance between outer surface 106 and inner surface 64. As yet another example, orientation-regulating structure 160 may control and/or regulate a maximum distance between outer surface 106 and inner surface 64. As another example, orientation-regulating structure 160 may control and/or regulate device 100 to a more specific position within the cross-section of wellbore conduit 62. As examples, and with reference to FIG. 4, orientation-regulating structure 160 may be adapted, configured, designed, and/or constructed to urge and/or maintain device 100 at and/or near a 12:00 position within wellbore conduit 62, as indicated at 178, a 3:00 position within wellbore conduit 62, as indicated at 180, a 6:00 position within wellbore conduit 62, as indicated at 182, and/or a 9:00 position within wellbore conduit 62, as indicated at 184.

12:00 position 178, 3:00 position 180, 6:00 position 182, and 9:00 position 184 collectively may be referred to herein as clock positions and may designate different regions of the transverse cross-section of wellbore conduit 62 relative to positions on a common clock face. When the transverse cross-section is taken within a vertical portion 52 of wellbore conduit 62 (as illustrated in FIG. 1), a collective orientation of the clock positions may be arbitrarily selected in any suitable manner, although the relative radial spacing between the positions will remain constant. When the transverse cross-section is taken within a deviated portion 54 or horizontal portion 56 of wellbore conduit 62 (as illustrated in FIG. 1), 12:00 position 178 generally will be oriented vertically up, and 6:00 position 182 generally will be oriented vertically down; however, this is not required in all embodiments.

Figure 6:
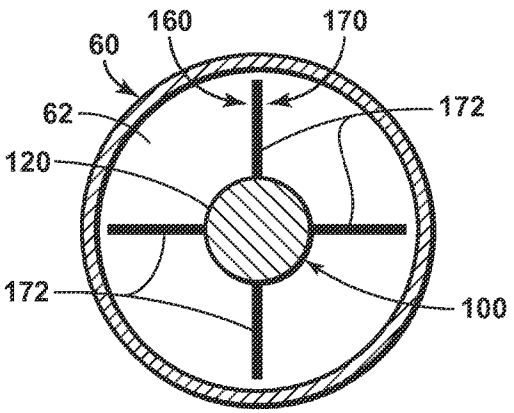
FIG. 6 is a schematic end view of an autonomous wellbore device according to the present disclosure, located within a wellbore conduit.

Control and/or regulation of the cross-sectional location of device 100 within the cross-section of wellbore conduit 62 may be accomplished in any suitable manner. As an example, and as illustrated in FIGS. 2 and 6-8, orientation-regulating structure 160 may include and/or be a cross-sectional location-regulating structure 170. As illustrated in FIG. 6, cross-sectional location-regulating structure 170 may include a plurality of projecting members 172 that may extend from a side of device 100. Each projecting member 172 may be utilized to maintain a desired separation distance between wellbore tubular 60 and a given side of device 100. Examples of projecting members 172 include any suitable bow spring, fin, and/or pin that may extend from device 100.

In the example of FIG. 6, cross-sectional location-regulating structure 170 includes four projecting members 172 that are symmetrically spaced apart around a periphery of device 100 and/or that maintain device 100 (at least substantially) centered within wellbore conduit 62. However, this is not required. For example, certain projecting members 172 may extend farther from device 100 than other projecting members 172, thereby maintaining device 100 at any suitable cross-sectional location within wellbore conduit 62. As another example, cross-sectional location-regulating structure 170 may include any suitable number of projecting members 172, including one, two, three, four, five, six, eight, or more than eight projecting members 172.

Figure 7:
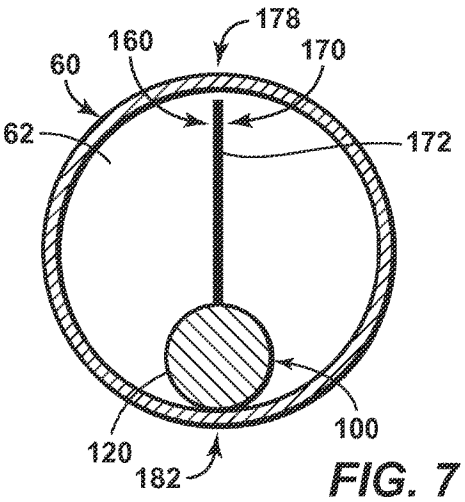
FIG. 7 is a schematic end view of an autonomous wellbore device according to the present disclosure, located within a wellbore conduit.

For example, and as illustrated in FIG. 7, cross-sectional location-regulating structure 170 may include a single projecting member 172. Under these conditions, device 100 may be weighted such that projecting member 172 maintains device 100 at, or near, a bottom portion of wellbore conduit 62 and/or near a 6:00 position 182 within wellbore conduit 62, as illustrated. However, device 100 also may be buoyant such that projecting member 172 maintains device 100 at, or near, a top portion of wellbore conduit 62 and/or near a 12:00 position 178 within wellbore conduit 62.

When cross-sectional location-regulating structure 170 includes one or more projecting members 172, the projecting members may include and/or be fixed projecting members 172 that are configured to project from device 100 regardless of a location and/or configuration of device 100. Alternatively, projecting members 172 also may be configured to transition from a retracted conformation, in which the projecting member does not regulate the cross-sectional location of tool 120 and/or in which projecting members 172 do not extend from device 100 (such as may be illustrated in FIGS. 3-5), to an expanded conformation, in which the projecting member does regulate the cross-sectional location of the wellbore tool (such as may be illustrated in FIGS. 6-7). The transition from the refracted conformation to the expanded conformation may be responsive to receipt of an expansion signal from control structure 140.

Figure 8:
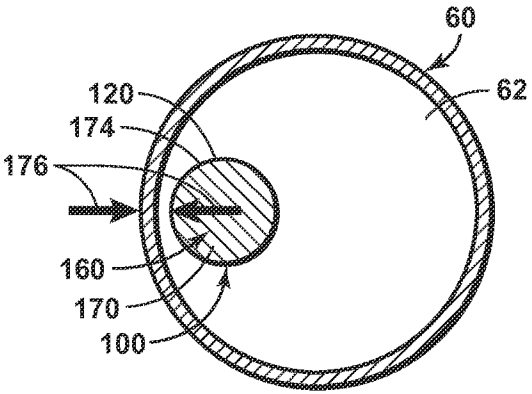
FIG. 8 is a schematic end view of an autonomous wellbore device according to the present disclosure, located within a wellbore conduit.

As yet another example, and as illustrated in FIG. 8, cross-sectional location-regulating structure 170 may include a magnet 174. Magnet 174 may generate a magnetic force 176, which may attract device 100 to wellbore tubular 60 and/or which may urge device 100 toward and/or into contact with wellbore tubular 60 when the wellbore tubular includes and/or is formed from a magnetic material. This may urge device 100 toward and/or maintain device 100 near a peripheral region of wellbore conduit 62 and/or may cause device 100 to contact wellbore tubular 60.

Figure 5:
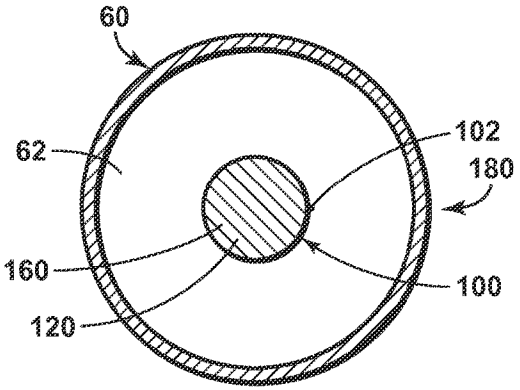
FIG. 5 is a schematic end view of the autonomous wellbore device of FIG. 3 rotated axially relative to the wellbore conduit.

As used herein, the phrase, "angular orientation" may refer to a rotational orientation of device 100 within the cross-section of wellbore conduit 62, and orientation-regulating structure 160 additionally or alternatively may be adapted, configured, designed, and/or constructed to control and/or regulate the angular orientation of device 100. This may include maintaining device 100 and/or tool 120 thereof at a target, desired, and/or predetermined angular orientation and/or selectively rotating device 100 among a plurality of different angular orientations, such as illustrated in FIGS. 3 and 5. In FIG. 3, a reference location 102 of device 100 is oriented at, or near, a top of device 100, or in a 12:00 position 178. In contrast, FIG. 5 illustrates reference location 102 of device 100 being rotated to a side of device 100, or to a 3:00 position 180. FIGS. 3 and 5 illustrate two different angular orientations for device 100 within wellbore conduit 62; however, it is within the scope of the present disclosure that orientation-regulating structure 160 may be utilized to maintain device 100 and/or tool 120 thereof at any suitable angular orientation and/or to selectively rotate device 100 and/or tool 120 thereof to any suitable, or desired, angular orientation within wellbore conduit 62.

Figure 10:
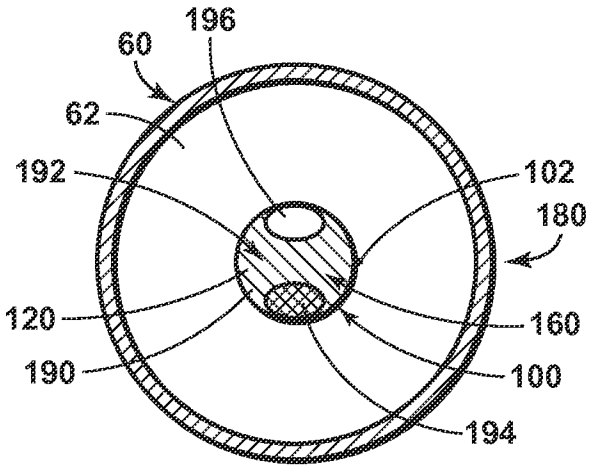
FIG. 10 is a schematic end view of an autonomous wellbore device according to the present disclosure, located within a wellbore conduit.
Figure 9:
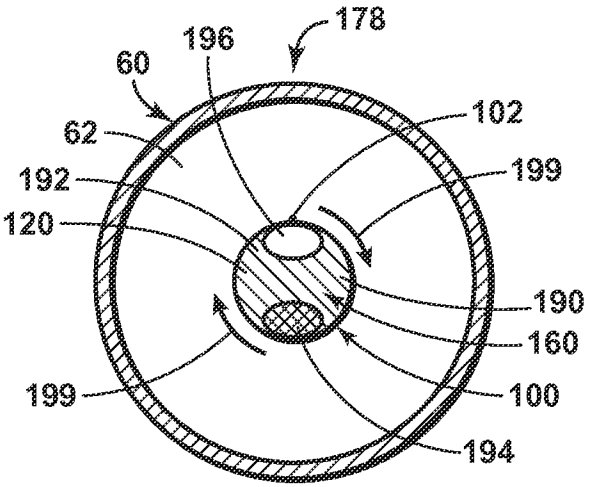
FIG. 9 is a schematic end view of an autonomous wellbore device according to the present disclosure, located within a wellbore conduit.

Control and/or regulation of the angular orientation of device 100 within the cross-section of wellbore conduit 62 may be accomplished in any suitable manner. As an example, and as illustrated in FIGS. 2 and 9-10, orientation-regulating structure 160 may include and/or be an angular orientation-regulating structure 190. Angular orientation-regulating structure 190 may be adapted, configured, designed, and/or constructed to maintain device 100 and/or tool 120 thereof within a target angular orientation range when device 100 is located within wellbore conduit 62. Additionally or alternatively, angular orientation-regulating structure 190 may be adapted, configured, designed, and/or constructed to selectively rotate device 100 and/or tool 120 thereof among a plurality of different angular orientations and/or to a target, desired, and/or preselected angular orientation.

Angular orientation-regulating structure 190 may include and/or be any suitable structure. As an example, angular orientation-regulating structure 190 may include an asymmetrically weighted region 192. Asymmetrically weighted region 192 may be configured to regulate the angular orientation of device 100 and/or tool 120 via a gravitational force and/or via a buoyant force when device 100 is located within wellbore conduit 62.

As another example, angular orientation-regulating structure 190 may include a weight 194. Weight 194 may be orientated to maintain a weighted portion of device 100 and/or tool 120 vertically below a remainder of device 100 and/or tool 120 via the gravitational force.

As yet another example, angular orientation-regulating structure 190 may include a buoyant region 196. Buoyant region 196 may be orientated to maintain a buoyant portion of device 100 and/or of tool 120 vertically above a remainder of device 100 and/or tool 120 via a buoyant force. Examples of buoyant region 196 include regions that include and/or are formed from a foam, a frangible foam, a low-density foam, a syntactic foam, a phenolic foam, a gas-filled volume, and/or a void space.

As another example, angular orientation-regulating structure 190 may include an orientation-regulating gyroscope 198, as illustrated in FIG. 2. Returning to FIGS. 9-10, and regardless of an exact configuration of angular orientation-regulating structure 190, the angular orientation-regulating structure may be configured to selectively rotate device 100 and/or tool 120 thereof to change and/or adjust the angular orientation. For example, and as illustrated in FIG. 9, weight 194 and/or buoyant region 196 initially may be oriented such that a reference location 102 of device 100 is near a top of device 100 (or in 12:00 position 178). Subsequently, the weight and/or the buoyant region may be rotated, is indicated at 199, causing device 100 to rotate such that reference location 102 is at a different location (such as at a side of device 100 and/or in 3:00 position 180, as illustrated in FIG. 10).

Returning to FIG. 2, device 100 further may include an angular orientation-detecting structure 210. Angular orientation-detecting structure 210 may be configured to detect the angular orientation of device 100 and/or of tool 120 when device 100 is located within wellbore conduit 62. Examples of angular orientation-detecting structure 210 include any suitable angular orientation-detecting gyroscope, accelerometer, and/or inclinometer.

Angular orientation-detecting structure 210 may be adapted, configured, designed, and/or constructed to generate an angular orientation indication signal that is indicative of the angular orientation of device 100 and/or of tool 120. In addition, angular orientation-detecting structure 210 may be configured to convey the angular orientation indication signal to control structure 140. Under these conditions, control structure 140 may be configured to receive the angular orientation indication signal and/or to generate an angular orientation control signal that is based upon the angular orientation indication signal. Control structure 140 further may be configured to convey the angular orientation control signal to angular orientation-regulating structure 190 to control the operation of the angular orientation-regulating structure. In addition, angular orientation-regulating structure 190 may be configured to selectively adjust the angular orientation of device 100 and/or tool 120 based, at least in part, on the angular orientation control signal.

Angular orientation-regulating structure 190 may be configured to selectively vary the angular orientation of device 100 (or tool 120) based upon the angular orientation control signal in any suitable manner. As an example, asymmetrically weighted region 192, weight 194, and/or buoyant region 196 may be configured to move relative to a remainder of autonomous wellbore device 100. As another example, orientation-regulating gyroscope 198 may be configured to selectively rotate. As yet another example, angular orientation-regulating structure 190 may be configured to (or may include a structure that is configured to) vary a center-of-mass of device 100 in any suitable manner.

Autonomous wellbore device 100 also may include a wellbore structure detector 230. Wellbore structure detector 230 may be configured to determine and/or detect a location of one or more wellbore structures 232 (schematically illustrated in FIG. 14) that may be present within and/or proximal to wellbore conduit 62 and/or to determine and/or detect a location of the wellbore structure relative to device 100. Examples of wellbore structures 232 that may be detected by wellbore structure detector 230 include another wellbore tubular that extends within a wellbore 50 that contains wellbore tubular 60, a cable that extends within the wellbore, a communication node or line, and/or a sensor.

Wellbore structure detector 230, when present, may be configured to generate a wellbore structure location signal that is indicative of the location of the wellbore structure and to convey the wellbore structure location signal to control structure 140. Under these conditions, control structure 140 may control the operation of angular orientation-regulating structure 190 based, at least in part, on the wellbore structure location signal, as discussed in more detail herein. Examples of wellbore structure detector 230 include a magnetometer, an electromagnetic field detector, an electric field detector, a magnetic field detector, and/or an acoustic wave generator and detector.

As discussed, orientation-regulating structure 160 may be configured to regulate, control, maintain, and/or adjust the cross-sectional orientation of autonomous wellbore device 100 (or tool 120) while device 100 is being conveyed within wellbore conduit 62. Additionally or alternatively, orientation-regulating structure 160 may be configured to regulate, control, and/or adjust the cross-sectional orientation of device 100 (or tool 120) subsequent to device 100 reaching a target region of wellbore conduit 62.

As an example, autonomous wellbore device 100 further may include a retention structure 240. Retention structure 240 may be configured to be actuated (such as via receipt of an actuation signal from control structure 140) subsequent to device 100 reaching a target region of the wellbore conduit and to retain device 100 within the target region of the wellbore conduit. Under these conditions, orientation-regulating structure 160 may be configured to adjust the cross-sectional orientation of device 100 and/or of tool 120 within wellbore conduit 62 subsequent to device 100 being retained within the wellbore conduit. This may include translation of at least a portion of device 100 (such as tool 120) to adjust the cross-sectional location of the portion of device 100 and/or rotation of the portion of device 100 to adjust the angular orientation of the portion of device 100.

It is within the scope of the present disclosure that orientation-regulating structure 160 may control and/or regulate the cross-sectional orientation of autonomous wellbore device 100 in any suitable manner and/or at any suitable time when device 100 is located within wellbore conduit 62. For example, orientation-regulating structure 160 may include and/or be a passive orientation-regulating structure 160 that is configured to passively regulate the cross-sectional orientation of device 100 and/or tool 120 thereof. As another example, orientation-regulating structure 160 may include and/or be an active orientation-regulating structure 160 that is configured to actively and/or selectively regulate the cross-sectional orientation of device 100 and/or tool 120 thereof.

When orientation-regulating structure 160 is active orientation-regulating structure 160, orientation-regulating structure 160 may include an unregulating state and a regulating state. In the unregulating state, orientation-regulating structure 160 may not regulate the cross-sectional orientation of device 100, while, in the regulating state, orientation-regulating structure 160 may regulate the cross-sectional orientation of device 100.

Active orientation-regulating structure 160 may be configured to transition from the unregulating state to the regulating state responsive to satisfaction of an orientation-regulation criterion. Examples of the orientation-regulation criterion include one or more of autonomous wellbore device 100 being conveyed autonomously within wellbore conduit 62 for at least a first threshold conveyance time, device 100 being in contact with a wellbore fluid that is present within wellbore conduit 62 for at least a first threshold contact time, device 100 being conveyed autonomously along wellbore conduit 62 for at least a first threshold conveyance distance, device 100 being conveyed autonomously past at least a first threshold number of casing collars of wellbore tubular 62, device 100 exceeding a first threshold depth within the subterranean formation, and/or device 100 being subjected to at least a first threshold pressure while being conveyed along wellbore conduit 62.

When autonomous wellbore device 100 includes active orientation-regulating structure 160, control structure 140 may be programmed to determine that the orientation-regulation criterion has been satisfied. Control structure 140 further may be programmed to send a transition signal to the active orientation-regulating structure responsive to determining that the orientation-regulation criterion has been satisfied. Under these conditions, active orientation-regulating structure 160 may be configured to transition from the unregulating state to the regulating state responsive to receipt of the transition signal.

Wellbore tool 120 may be configured to receive an actuation signal, such as from control structure 140, and to autonomously perform the downhole operation responsive to receipt of the actuation signal. The downhole operation may be performed while device 100 is located within wellbore conduit 62 and may include any suitable downhole operation. Examples of wellbore tool 120 include a plug, a packer, a diversion device, a detector, and/or a perforation device 122.

When tool 120 includes perforation device 122, the perforation device may include a perforation charge 124 that is configured to be selectively actuated to create a perforation within wellbore tubular 62. For example, perforation charge 124 may be actuated responsive to receipt of the actuation signal, in the form of a perforation signal, by tool 120. Examples of autonomous wellbore devices 100 that include tools 120 in the form of perforation devices 122, as well as orientations thereof that may be obtained utilizing the systems and methods disclosed herein, are illustrated in FIGS. 11-14.

Figure 11:
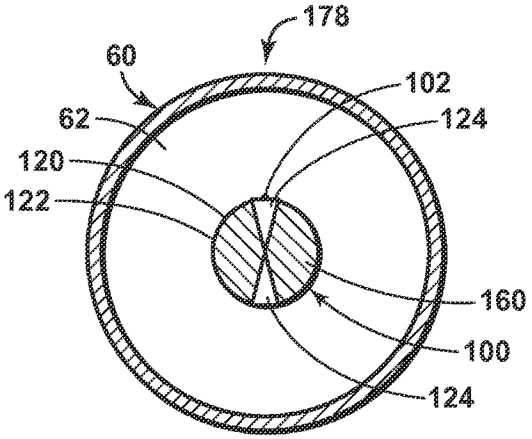
FIG. 11 is a schematic end view of an autonomous wellbore device according to the present disclosure, located within a wellbore conduit.

In FIG. 11, autonomous wellbore device 100 includes two perforation charges 124 that are opposed to one another and/or that face in opposite directions. In addition, orientation-regulating structure 160 has oriented (or has been utilized to orient) device 100 such that the two perforation charges 124 are oriented vertically. Furthermore, orientation-regulating structure 160 also has oriented (or has been utilized to orient) device 100 such that device 100 is (at least substantially) centered within wellbore conduit 62. Thus, perforation device 122 is oriented to perforate wellbore tubular 60 at the top and bottom thereof (e.g., in 12:00 position 178 and 6:00 position 182).

Figure 12:
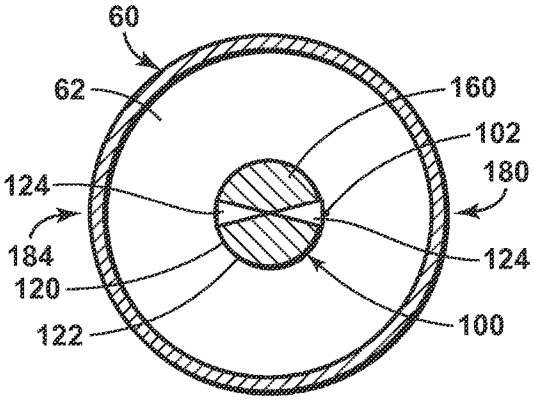
FIG. 12 is a schematic end view of the autonomous wellbore device of FIG. 11 rotated axially relative to the wellbore conduit.

In contrast, FIG. 12 illustrates that orientation-regulating structure 160 has oriented (or has been utilized to orient) autonomous wellbore device 100 such that the two perforation charges 124 are oriented horizontally. Thus, perforation device 122 is oriented to perforate wellbore tubular 60 on the sides thereof (e.g., in 3:00 position 180 and 9:00 position 184).

Figure 13:
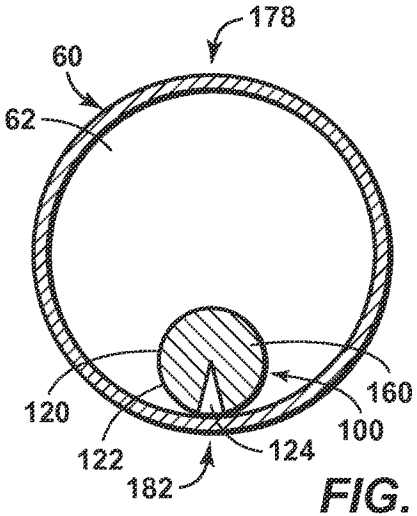
FIG. 13 is a schematic end view of an autonomous wellbore device according to the present disclosure, located within a wellbore conduit.

In FIG. 13, autonomous wellbore device 100 includes a single perforation charge 124. In addition, orientation-regulating structure 160 has oriented (or has been utilized to orient) device 100 such that device 100 is located at, or near, a bottom of wellbore conduit 62 and/or such that the perforation is directed toward the 6:00 position 182 within the wellbore conduit. Thus, the perforation charge is oriented to perforate wellbore tubular on the bottom thereof (e.g., in the 6:00 position 182).

Figure 14:
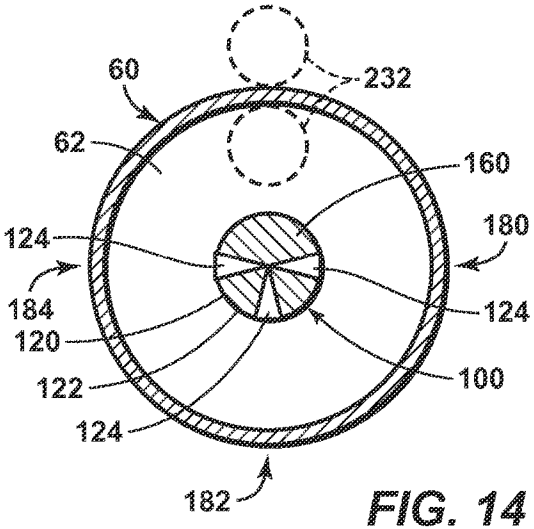
FIG. 14 is a schematic end view of an autonomous wellbore device according to the present disclosure, located within a wellbore conduit.

In FIG. 14, autonomous wellbore device 100 includes three perforation charges 124 that are oriented at (approximately) 90 degrees relative to one another. In addition, wellbore conduit 62 includes (or wellbore tubular 60 is proximal to) a wellbore structure 232. Furthermore, orientation-regulating structure 160 of device 100 has oriented (or has been utilized to orient) device 100 such that perforation charges 124 are not facing toward (or directly toward) wellbore structure 232, such as to avoid perforation of wellbore structure 232 by perforation charges 124. Examples of wellbore structure 232 are disclosed herein.

Returning to FIG. 2, control structure 140 may be operatively affixed to wellbore tool 120 and/or orientation-regulating structure 160 and/or may be configured to be conveyed autonomously within wellbore conduit 62 with wellbore tool 120 and/or with orientation-regulating structure 160. In addition, control structure 140 may be programmed to control the operation of at least a portion of autonomous wellbore device 100. As an example, control structure 140 may be programmed to determine that the actuation criterion has been satisfied and to provide the actuation signal to tool 120 responsive to satisfaction of the actuation criterion. Examples of control structure 140 and/or components thereof include any suitable autonomous electronic controller, dedicated controller, operation-specific controller, microprocessor, memory device, transistor, and/or relay.

As illustrated in dashed lines in FIG. 2, autonomous wellbore device 100 also may include an actuation criterion detector 260. Actuation criterion detector 260 may be configured to detect that the actuation criterion has been satisfied and/or to provide a criterion satisfaction signal to control structure 140 responsive to satisfaction of the actuation criterion. As an example, device 100 may include a conveyance timer that is configured to determine a conveyance time for device 100 within wellbore conduit 62, and the actuation criterion may include the conveyance time exceeding a second threshold conveyance time. The second threshold conveyance time may be the same as or different from the first threshold conveyance time.

As another example, autonomous wellbore device 100 may include a contact timer that is configured to determine a contact time that device 100 has been in contact with the wellbore fluid that is present within wellbore conduit 62, and the actuation criterion may include the contact time exceeding a second threshold contact time. The second threshold contact time may be the same as or different from the first threshold contact time.

As yet another example, autonomous wellbore device 100 may include a conveyance distance detector that is configured to detect a conveyance distance that device 100 has been conveyed along wellbore conduit 62, and the actuation criterion may include the conveyance distance exceeding a second threshold conveyance distance. The second threshold conveyance distance may be the same as or different from the first threshold conveyance distance.

As another example, autonomous wellbore device 100 may include a casing collar detector that is configured to count a number of casing collars of wellbore tubular 60 that device 100 has been conveyed past within wellbore conduit 62, and the actuation criterion may include the number of casing collars exceeding a second threshold number of casing collars. The second threshold number of casing collars may be the same as or different from the first threshold number of casing collars.

As yet another example, autonomous wellbore device 100 may include a depth detector that is configured to determine a depth of device 100 within the subterranean formation, and the actuation criterion may include the depth of device 100 exceeding a second threshold depth. The second threshold depth may be the same as or different from the first threshold depth.

As another example, the actuation criterion may include autonomous wellbore device 100 and/or tool 120 thereof being within a target portion of a transverse cross-section of wellbore conduit 62 (i.e., at a target, or desired, cross-sectional location within the wellbore conduit). As yet another example, the actuation criterion may include autonomous wellbore device 100 being at a target rotational orientation within wellbore conduit 62 (i.e., at a target, or desired, angular orientation within the wellbore conduit).

It is within the scope of the present disclosure that autonomous wellbore device 100 and/or any suitable component thereof may be frangible and/or may be configured to break apart, break into pieces, dissolve, and/or disintegrate within wellbore conduit 62 subsequent to performing the downhole operation and/or after prolonged contact with the wellbore fluid. As such, device 100 may not form, or be, a long-term obstruction within wellbore conduit 62, and a hydrocarbon well that utilizes device 100 may be brought up to production without a separate removal operation first being performed to remove device 100 from the hydrocarbon well. As examples, autonomous wellbore device 100, tool 120, control structure 140, and/or orientation-regulating structure 160 may be formed from a frangible material. As additional examples, device 100, tool 120, control structure 140, and/or orientation-regulating structure 160 may be formed from a material that is configured to dissolve within the wellbore fluid. As a more specific example, and when tool 120 includes perforation device 122, actuation of perforation charge(s) 124 also may cause at least a portion, or even all, of device 100 to break into pieces within wellbore conduit 62.

Figure 15:
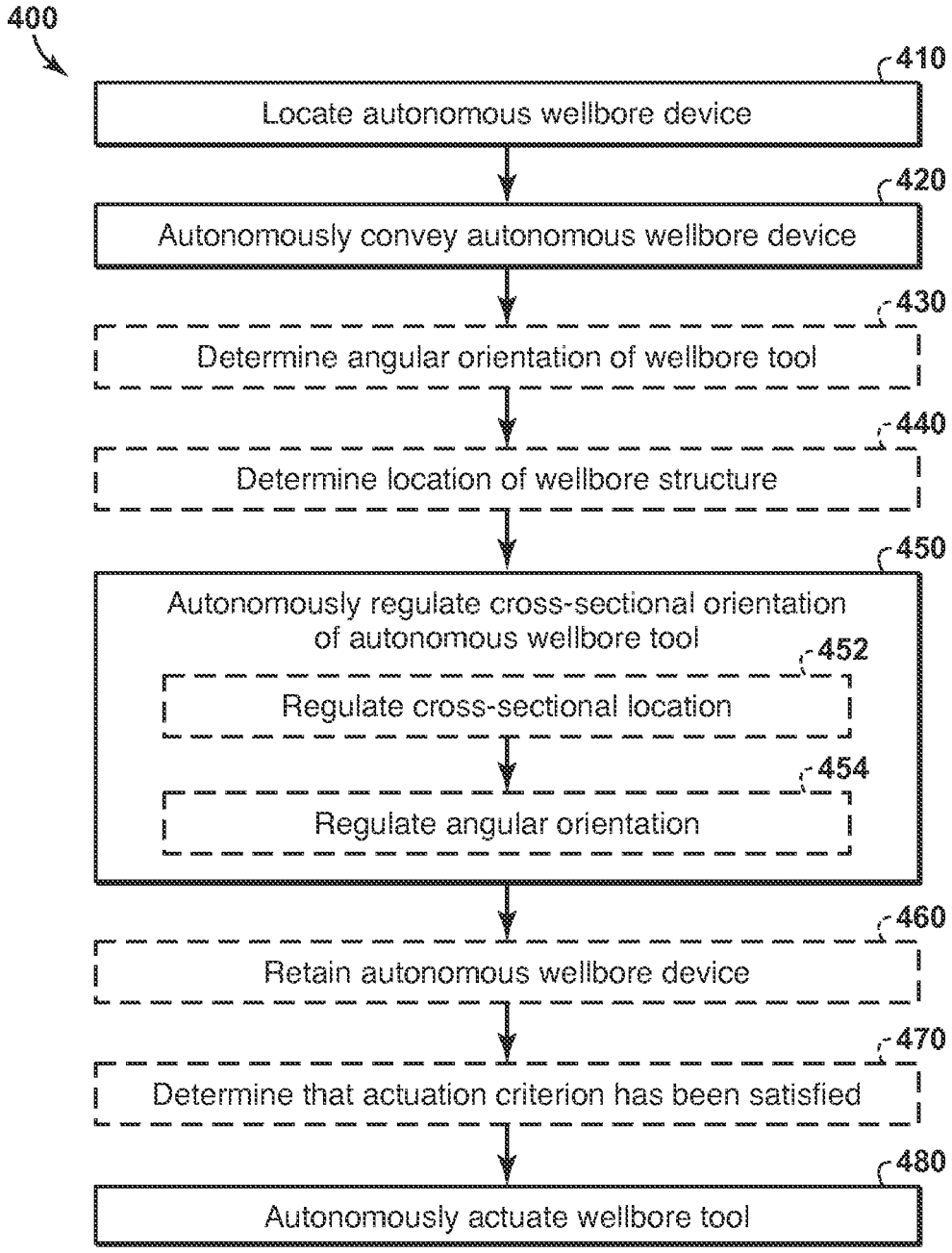
FIG. 15 is a flowchart depicting methods of performing a downhole operation with an autonomous wellbore device according to the present disclosure.

FIG. 15 is a flowchart depicting methods 400 of performing a downhole operation with an autonomous wellbore device 100 according to the present disclosure. Methods 400 include locating an autonomous wellbore device that includes a wellbore tool within a wellbore conduit at 410 and autonomously conveying the autonomous wellbore device within the wellbore conduit at 420. Methods 400 further may include determining an angular orientation of the wellbore tool at 430 and/or determining a location of a wellbore structure at 440 and include autonomously regulating a cross-sectional orientation of the wellbore tool at 450. Methods 400 further may include retaining the autonomous wellbore device within the wellbore conduit at 460 and/or determining that an actuation criterion has been satisfied at 470 and include autonomously actuating the wellbore tool at 480.

Locating the autonomous wellbore device within the wellbore conduit at 410 may include locating the autonomous wellbore device within any suitable wellbore conduit that may be defined by a wellbore tubular that extends within a subterranean formation and/or that extends between a surface region and the subterranean formation. As an example, the locating at 410 may include placing the autonomous wellbore device within a lubricator and lubricating the autonomous wellbore device into the wellbore tubular. As another example, the locating at 410 may include locating the autonomous wellbore device within the wellbore conduit without maintaining, establishing, and/or permitting a physical connection between the autonomous wellbore device and the lubricator, the surface region, and/or the wellbore tubular.

Autonomously conveying the autonomous wellbore device within the wellbore conduit at 420 may include autonomously conveying the autonomous wellbore device in a downhole direction within the wellbore conduit and/or to, or into, a downhole portion of the wellbore conduit. The downhole portion of the wellbore conduit may be located and/or may extend within the subterranean formation.

The conveying at 420 may be performed in any suitable manner. For example, the conveying at 420 may include providing a fluid to the wellbore conduit, such as from the surface region, and flowing the autonomous wellbore device in the downhole direction with the fluid. The conveying at 420 additionally or alternatively may include permitting a gravitational force to autonomously convey the autonomous wellbore device within the wellbore conduit. As yet another example, the conveying at 420 may include conveying without maintaining and/or permitting the physical connection between the autonomous wellbore device and the lubricator, the surface region, and/or the wellbore tubular.

Determining the angular orientation of the wellbore tool at 430 may include determining any suitable angular orientation of the wellbore tool in any suitable manner. As an example, the determining at 430 may include determining with an angular orientation-detecting structure, examples of which are disclosed herein.

Determining the location of the wellbore structure at 440 may include determining the location of a wellbore structure that extends within the subterranean formation, extends within the wellbore conduit, extends proximal the wellbore conduit, and/or extends proximal to the autonomous wellbore device. This may include determining the location of the wellbore structure relative to the autonomous wellbore device with a wellbore structure detector, examples of which are disclosed herein.

Autonomously regulating the cross-sectional orientation of the wellbore tool at 450 may include autonomously regulating the cross-sectional orientation while the autonomous wellbore device is within the wellbore conduit and/or while the autonomous wellbore device is located within the downhole portion of the wellbore conduit. The regulating at 450 may be performed at any suitable time during methods 400. For example, the regulating at 450 may be at least partially (or even completely) concurrent with the conveying at 420, with the determining at 430, and/or with the determining at 440.

The regulating at 450 may include passively regulating the cross-sectional orientation of the wellbore tool. Alternatively, the regulating at 450 also may include actively regulating the cross-sectional orientation of the wellbore tool. As yet another example, the regulating at 450 may include selectively regulating the cross-sectional orientation of the wellbore tool. For example, the orientation-regulating structure may include, have, or define an unregulating state and a regulating state, and methods 400 may include transitioning the orientation-regulating structure from the unregulating state to the regulating state responsive to satisfaction of an orientation-regulation criterion. Examples of the orientation-regulation criterion are disclosed herein. When methods 400 include the transitioning from the unregulating state to the regulating state, the transitioning may be performed at least partially (or even completely) concurrently with the autonomously conveying at 420.

The autonomously regulating at 450 may include regulating a cross-sectional location of the autonomous wellbore device and/or of the wellbore tool within the wellbore conduit, as indicated at 452. This may include maintaining the autonomous wellbore device and/or the wellbore tool within a target portion of a transverse cross-section of the wellbore conduit. Examples of the cross-sectional location of the autonomous wellbore device are disclosed herein.

Additionally or alternatively, the autonomously regulating at 450 may include regulating an angular orientation of the autonomous wellbore device and/or of the wellbore tool within the wellbore conduit, as indicated at 454. This may include maintaining the autonomous wellbore device and/or the wellbore tool within a target angular orientation range. Examples of the angular orientation of the autonomous wellbore device are disclosed herein.

When methods 400 include the regulating at 454, the regulating at 454 may be based, at least in part, on the determining at 430. As an example, the target angular orientation range may be based, at least in part, on the determined angular orientation of the autonomous wellbore device and/or of the wellbore tool.

Additionally or alternatively, and when methods 400 include the regulating at 454, the regulating at 454 may be based, at least in part, on the determining at 440. As an example, the target angular orientation may be based, at least in part, on the location of the wellbore structure relative to the autonomous wellbore device.

As a more specific example, the wellbore tool may include a perforation device that is configured to create at least one perforation within the wellbore tubular, and the autonomously actuating at 480 may include creating the at least one perforation. Under these conditions, the target angular orientation may be selected such that the perforation gun does not perforate the wellbore structure during the autonomously actuating at 480. As additional examples, and when the wellbore tool includes the perforation device, the regulating at 452 may include centering the perforation device within the wellbore conduit, and/or the regulating at 454 may include rotating the perforation device such that the at least one perforation is formed at a desired angular orientation within the wellbore conduit.

Retaining the autonomous wellbore device within the wellbore conduit at 460 may include retaining the autonomous wellbore device in any suitable manner. As an example, the retaining at 460 may include actuating a packer that forms a portion of the autonomous wellbore device to retain the autonomous wellbore device within the wellbore conduit. Additionally or alternatively, the retaining at 460 may include receiving the autonomous wellbore device on a ring and/or baffle that may be present within the wellbore conduit and/or that may be operatively affixed to the wellbore tubular. When methods 400 include the retaining at 460, the autonomously regulating at 450 may be performed prior to and/or subsequent to the retaining at 460. In addition, the autonomously actuating at 480 may be performed subsequent to the retaining at 460.

Determining that the actuation criterion has been satisfied at 470 may include determining that any suitable actuation criterion has been satisfied in any suitable manner. As an example, the determining at 470 may include determining with an actuation criterion detector, examples of which are disclosed herein. Examples of the actuation criterion also are disclosed herein. When methods 400 include the determining at 470, the autonomously actuating at 480 may be based upon, responsive to, and/or performed subsequent to the actuation criterion being satisfied.

Autonomously actuating the wellbore tool at 480 may include autonomously actuating the wellbore tool to perform the downhole operation while the autonomous wellbore device is within the downhole portion of the wellbore conduit. The autonomously actuating at 480 may be at least partially concurrent with (or performed during) the autonomously conveying at 420, the determining at 430, the determining at 440, and/or the autonomously regulating at 450.

The autonomously actuating at 480 may be performed and/or initiated based upon any suitable criterion. As an example, the autonomously actuating at 480 may be performed subsequent to and/or responsive to satisfaction of the actuation criterion.

As discussed herein, the autonomous wellbore device may be frangible and/or may be configured to break apart within the wellbore conduit. Under these conditions, the autonomously actuating at 480 further may include breaking apart the autonomous wellbore tool within the wellbore conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. An autonomous wellbore device, comprising:

a wellbore tool configured to, responsive to receipt of an actuation signal, autonomously perform a downhole operation within a wellbore conduit that is defined by a wellbore tubular that extends within a subterranean formation;

a control structure configured to be conveyed autonomously within the wellbore conduit with the wellbore tool and programmed to:

(i) determine that an actuation criterion has been satisfied; and (ii) provide the actuation signal to the wellbore tool responsive to satisfaction of the actuation criterion; and an orientation-regulating structure comprising at least one of a gyroscope and a buoyant region autonomously conveyable within the wellbore conduit with the wellbore tool and to regulate a cross-sectional orientation of the wellbore tool within the wellbore conduit with respect to a cross-sectional center of the wellbore conduit, while the autonomous wellbore device is autonomously conveyed within the wellbore conduit, the orientation-regulating structure configured to;

(a) determine that an orientation-regulation criterion has been satisfied with respect to an orientation of the wellbore tool; and (b) provide an orientation indication signal to the control structure responsive to satisfaction of the orientation-regulation criterion.

2. The device of claim 1, wherein the orientation-regulating structure is an active orientation-regulating structure configured to actively regulate the cross-sectional orientation of the wellbore tool within the wellbore conduit while the autonomous wellbore device is being conveyed autonomously within the wellbore conduit.

3. The device of claim 2, wherein the orientation-regulating structure has an unregulating state, in which the orientation-regulating structure is not regulating the cross-sectional orientation of the wellbore tool, and a regulating state, in which the orientation-regulating structure is regulating the cross-sectional orientation of the wellbore tool, and further wherein the orientation-regulating structure is configured to transition from the unregulating state to the regulating state responsive to an orientation-regulation criterion being satisfied.

4. The device of claim 3, wherein the orientation-regulation criterion includes at least one of:

(i) the autonomous wellbore device being conveyed autonomously within the wellbore conduit for at least a threshold conveyance time;

(ii) the autonomous wellbore device being in contact with a wellbore fluid that is present within the wellbore conduit for at least a threshold contact time;

(iii) the autonomous wellbore device being conveyed autonomously along the wellbore conduit for at least a threshold conveyance distance;

(iv) the autonomous wellbore device being conveyed autonomously past at least a threshold number of casing collars of the wellbore tubular;

(v) the autonomous wellbore device exceeding a threshold depth within the subterranean formation; and (vi) the autonomous wellbore device being subjected to at least a threshold pressure while being conveyed autonomously along the wellbore conduit.

5. The device of claim 3, wherein the control structure is programmed to determine that the orientation-regulation criterion has been satisfied and to send a transition signal to the orientation-regulating structure responsive to determining that the orientation-regulation criterion has been satisfied, wherein the orientation-regulating structure is configured to transition from the unregulating state to the regulating state responsive to receipt of the transition signal.

6. The device of claim 1, wherein the orientation-regulating structure includes a cross-sectional location-regulating structure configured to regulate a cross-sectional location of the wellbore tool within a desired position within the wellbore conduit with respect to a cross-sectional center of the wellbore conduit.

7. The device of claim 6, wherein the cross-sectional location-regulating structure includes a projecting member that extends from a side of the autonomous wellbore device, wherein the projecting member is oriented to maintain a desired separation distance between the a cross-sectional center of the wellbore conduit and the side of the autonomous wellbore device.

8. The device of claim 6, wherein the cross-sectional location-regulating structure includes a magnet configured to generate a magnetic force to attract a portion of the autonomous wellbore device to the wellbore tubular.

9. The device of claim 1, wherein the orientation-regulating structure includes an angular orientation-regulating structure configured to regulate an angular orientation of the wellbore tool within the wellbore conduit with respect to a cross-sectional center of the wellbore conduit.

10. The device of claim 9, wherein the angular orientation-regulating structure includes an asymmetrically weighted region configured to regulate the angular orientation of the wellbore tool via gravitational force.

11. The device of claim 9, wherein the angular orientation-regulating structure includes an orientation-regulating gyroscope.

12. The device of claim 9, wherein the autonomous wellbore device further includes an angular orientation-detecting structure configured to detect the angular orientation of the wellbore tool within the wellbore conduit, wherein the angular orientation-detecting structure is configured to generate an angular orientation indication signal that is indicative of the angular orientation of the wellbore tool within the wellbore conduit and to convey the angular orientation indication signal to the control structure, wherein the control structure is configured to generate an angular orientation control signal that is based, at least in part, on the angular orientation indication signal and to convey the angular orientation control signal to the angular orientation-regulating structure to control operation of the angular orientation-regulating structure, and further wherein the angular orientation-regulating structure is configured to adjust the angular orientation of the wellbore tool based, at least in part, on the angular orientation control signal.

13. The device of claim 9, wherein the autonomous wellbore device further includes a wellbore structure detector configured to detect a location of a wellbore structure relative to the autonomous wellbore device, wherein the wellbore structure detector is configured to generate a wellbore structure location signal that is indicative of the location of the wellbore structure relative to the autonomous wellbore device and to convey the wellbore structure location signal to the control structure, and further wherein the control structure is configured to control operation of the angular orientation-regulating structure based, at least in part, on the wellbore structure location signal.

14. The device of claim 1, wherein the autonomous wellbore tool further includes a retention structure configured to be actuated to retain the autonomous wellbore device within a target region of the wellbore conduit, and further wherein the orientation-regulating structure is configured to adjust the cross-sectional orientation of the wellbore tool within the wellbore conduit subsequent to the autonomous wellbore device being retained within the target region of the wellbore conduit.

15. The device of claim 1, wherein the wellbore tool is a perforation device, and further wherein the downhole operation includes formation of at least one perforation within the wellbore tubular.

16. The device of claim 1, wherein the wellbore tool, the control structure, and the orientation-regulating structure are operatively attached to one another and sized to be deployed within the wellbore conduit as a single unit.

17. A method of performing a downhole operation with an autonomous wellbore device that includes a wellbore tool, the method comprising:

locating the autonomous wellbore device within a wellbore conduit that is defined by a wellbore tubular that extends within a subterranean formation;

conveying the autonomous wellbore device in a downhole direction within the wellbore conduit and to a downhole portion of the wellbore conduit;

autonomously regulating a cross-sectional orientation of the wellbore tool within the wellbore conduit with respect to a cross-sectional center of the wellbore conduit using at least one of an orientation-regulating gyroscope and an orientation regulating buoyant portion of the wellbore tool, while the autonomous wellbore device is within the downhole portion of the wellbore conduit;

determining with the orientation-regulating structure that an orientation-regulation criterion has been satisfied with respect to an orientation of the wellbore tool;

providing an orientation indication signal to the control structure responsive to satisfaction of the orientation-regulation criterion; and autonomously actuating the wellbore tool to perform the downhole operation while the autonomous wellbore device is within the downhole portion of the wellbore conduit.

18. The method of claim 17, wherein the autonomously regulating is at least partially concurrent with the autonomously conveying.

19. The method of claim 17, wherein the autonomously regulating includes actively regulating the cross-sectional orientation of the wellbore tool.

20. The method of claim 17, wherein the autonomously regulating includes transitioning the orientation-regulating structure from an unregulating state to a regulating state responsive to an orientation-regulation criterion being satisfied.

21. The method of claim 17, wherein the autonomously regulating includes maintaining the wellbore tool within a target portion of a transverse cross-section of the wellbore conduit.

22. The method of claim 17, wherein the autonomously regulating includes maintaining the wellbore tool within a target angular orientation range.

23. The method of claim 22, wherein the method further includes determining an angular orientation of the wellbore tool within the wellbore conduit, and further wherein the maintaining the wellbore tool within the target angular orientation range is based, at least in part, on the determined angular orientation.

24. The method of claim 22, wherein the method further includes determining a location of a wellbore structure relative to the autonomous wellbore device, and further wherein the target angular orientation range is based, at least in part, on the location of the wellbore structure relative to the autonomous wellbore device.

25. The method of claim 17, wherein the autonomously actuating is at least partially concurrent with the autonomously conveying.

26. The method of claim 17, wherein the method further includes retaining the autonomous wellbore device within a target region of the wellbore conduit, wherein the autonomously regulating is subsequent to the retaining, and further wherein the autonomously actuating is subsequent to the retaining.

27. The method of claim 17, wherein the wellbore tool is a perforation device, and further wherein the autonomously actuating includes creating at least one perforation within the wellbore tubular with the perforation device.

* * * * *